US007188749B2

(12) United States Patent
Miller et al.

(10) Patent No.: US 7,188,749 B2
(45) Date of Patent: Mar. 13, 2007

(54) CONTAINER ADAPTED TO HOLD AND DISPENSE BAGGED FLUIDS

(75) Inventors: Don Miller, Belleville, IL (US); Henry H. Macler, II, Monroe, LA (US); Jeffrey E. Macler, Tecumseh, MO (US); Steven Avery, South Jordan, UT (US)

(73) Assignee: AMMM Patent Holdings, LLC, Tecumseh, MO (US)

( * ) Notice: Subject to any disclaimer, the term of this patent is extended or adjusted under 35 U.S.C. 154(b) by 0 days.

(21) Appl. No.: 10/973,052

(22) Filed: Oct. 25, 2004

(65) Prior Publication Data

US 2005/0121464 A1 Jun. 9, 2005

Related U.S. Application Data

(60) Provisional application No. 60/545,155, filed on Feb. 17, 2004, provisional application No. 60/513,769, filed on Oct. 23, 2003.

(51) Int. Cl.
*B65D 35/28* (2006.01)
*B65D 35/56* (2006.01)

(52) U.S. Cl. ..... 222/1; 222/83; 222/95; 222/105

(58) Field of Classification Search ..... 222/81, 222/37, 105, 185.1, 83, 95, 1
See application file for complete search history.

(56) References Cited

U.S. PATENT DOCUMENTS 1,316,122 A 9/1919 Vall
1,364,889 A 1/1921 Rupp
1,889,557 A 4/1932 Lange
2,655,286 A * 10/1953 Barbaro ..... 222/82
3,239,104 A 3/1966 Scholle
3,255,923 A 6/1966 Soto
3,587,934 A 6/1971 Elmore
3,688,950 A 9/1972 Parish
3,813,009 A 5/1974 Lenz (Continued)

FOREIGN PATENT DOCUMENTS

CA 1 229 073 8/1985

(Continued)

OTHER PUBLICATIONS

Web page-http://www.concessionstands.com/itemdesc.asp?CartId=800269GSS-EVEREST-VO750..., JARCO: Server Express Rectangular Stainless, Model 07020, p. 1-2, Oct. 22, 2002.

(Continued)

*Primary Examiner*—Joseph A. Kaufman
(74) *Attorney, Agent, or Firm*—Lewis, Rice & Fingersh, L.C.

(57) ABSTRACT

A fluid dispensing apparatus comprising a bag containing fluid, a container that provides support for the bag, a spike comprising a hollow stem through which fluid can flow, the spike being connected to the bag at a joint created upon the puncturing of the bag by the spike, and a dispensing mechanism for controlling the flow of fluid from the bag, which dispensing mechanism is connected to the hollow stem, and wherein the dispensing mechanism is operated to allow fluid flow.

23 Claims, 10 Drawing Sheets

U.S. PATENT DOCUMENTS

| | | | | |
|---|---|---|---|---|
| 3,848,776 | A | 11/1974 | Schiesser | |
| 4,318,497 | A * | 3/1982 | Friedrich | 222/83 |
| 4,322,465 | A | 3/1982 | Webster | |
| 4,527,716 | A | 7/1985 | Haas et al. | |
| 4,561,560 | A | 12/1985 | Lyon | |
| 4,755,292 | A | 7/1988 | Merriam | |
| 4,795,062 | A | 1/1989 | Bedwell et al. | |
| 4,801,007 | A | 1/1989 | Rule | |
| 4,846,236 | A | 7/1989 | Deruntz | |
| 4,865,218 | A | 9/1989 | Derby et al. | |
| 4,907,722 | A * | 3/1990 | Ueda et al. | 222/83 |
| 5,029,734 | A * | 7/1991 | Nichols | 222/105 |
| 5,050,775 | A * | 9/1991 | Marquardt | 222/93 |
| 5,141,134 | A | 8/1992 | Machado | |
| 5,224,619 | A | 7/1993 | Dilworth et al. | |
| 5,281,027 | A | 1/1994 | Thrall | |
| 5,325,995 | A | 7/1994 | Harrison | |
| 5,334,180 | A | 8/1994 | Adolf | |
| D361,838 | S | 8/1995 | Kuhn et al. | |
| 5,505,336 | A | 4/1996 | Montgomery et al. | |
| 5,551,606 | A | 9/1996 | Rai et al. | |
| 5,567,322 | A | 10/1996 | Rundle et al. | |
| 5,573,047 | A | 11/1996 | Akin | |
| 5,645,913 | A | 7/1997 | Rogers | |
| 5,691,015 | A | 11/1997 | Tsukamoto et al. | |
| 5,746,347 | A * | 5/1998 | Riedemann et al. | 222/1 |
| 5,944,232 | A | 8/1999 | Hestehave et al. | |
| 5,967,197 | A | 10/1999 | Shown | |
| 5,975,359 | A * | 11/1999 | Van Marcke | 222/82 |
| 6,026,988 | A | 2/2000 | Teetsel, III et al. | |
| 6,095,433 | A | 8/2000 | Langdon | |
| 6,098,844 | A | 8/2000 | Nicolle | |
| 6,116,467 | A * | 9/2000 | Petriekis et al. | 222/105 |
| 6,149,034 | A | 11/2000 | Amberg et al. | |
| 6,207,046 | B1 | 3/2001 | Yamashita et al. | |
| 6,223,940 | B1 | 5/2001 | Quinn | |
| 6,228,011 | B1 * | 5/2001 | Takemura et al. | 493/87 |
| 6,398,073 | B1 * | 6/2002 | Nicolle | 222/67 |
| 6,442,960 | B1 | 9/2002 | Fournier et al. | |
| 6,557,735 | B1 | 5/2003 | Stray | |
| 6,726,061 | B2 | 4/2004 | Good | |
| 6,883,683 | B1 * | 4/2005 | Cunningham et al. | 222/107 |
| 2004/0104246 | A1 * | 6/2004 | Kawaguchi et al. | 222/83 |

FOREIGN PATENT DOCUMENTS

| | | |
|---|---|---|
| CA | 1 192 164 | 11/1987 |
| CN | 98213085.6 | 6/1999 |
| CN | 98215283.3 | 7/1999 |
| CN | 99209220.5 | 4/2000 |
| CN | 99246066.2 | 9/2000 |
| CN | 99246067.0 | 9/2000 |
| CN | 99254569.2 | 2/2001 |
| CN | 00237624.5 | 5/2001 |
| CN | 00237625.3 | 7/2001 |
| CN | 02309721.2 | 8/2004 |
| CN | 03209721.2 | 8/2004 |
| CN | 03231908.8 | 8/2004 |
| CN | 03231906.1 | 9/2004 |
| CN | 03210115.5 | 10/2004 |
| CN | 200320100534.9 | 3/2005 |
| CN | 200410052994.8 | 3/2005 |
| CN | 200410067280.4 | 3/2005 |
| CN | 200420005755.2 | 3/2005 |
| CN | 200420037745.7 | 7/2005 |
| CN | 200420107401.9 | 11/2005 |
| EP | 0 250 640 | 9/1986 |
| FR | 2685293 | 6/1993 |

OTHER PUBLICATIONS

Web page-http://www.sealedair.com/library/casehist/rtm_rest.html, RTM Restaurant Group—Cryovac Division of Sealed Air Case History, p. 1-5, Oct. 22, 2004.

* cited by examiner

CONTAINER ADAPTED TO HOLD AND DISPENSE BAGGED FLUIDS

CROSS REFERENCE TO RELATED APPLICATIONS

This application claims the benefit of U.S. Provisional Patent Applications No. 60/513,769, filed Oct. 23, 2003, and 60/545,155, filed Feb. 17, 2004, the entire disclosures of which are herein incorporated by reference.

BACKGROUND OF THE INVENTION

1. Field of Invention

The invention relates generally to a dispensing apparatus for bagged fluids.

2. Description of Related Art

Liquid storage vessels such as jugs or pitchers are essentially ubiquitous in society and have been around in a general form for centuries. A liquid storage vessel generally serves two purposes. It serves to contain a liquid so that the liquid does not spill, evaporate, or be soaked up by other objects from which it cannot easily be removed, and it serves as a way to dispense the liquid to users to drink, wash with, or otherwise utilize.

As technology has improved, the jug has become lighter, easier to use and store, and easier to handle and dispense from. At the same time, the general concept remains relatively unchanged. Most traditional vessels are shaped so the liquid is contained by gravity in a portion of the device. When the device is tilted or upended, the liquid is placed into contact with a hole which allows it to be dispensed to the user. While this is a universally used design, it is not always the best choice from a storage point of view.

In the modern household, liquids to be consumed are most often stored in a refrigerator. This allows for the liquids to be cold which often provides improved taste characteristics as well as making the beverage more refreshing to consume and helping to preserve some beverages for a longer time. The design of most storage vessels is often wasteful when placed in a refrigerator and also does not always provide for as sanitary storage as would be desired.

To make such a vessel easy to pour from (upend), most vessels used currently are relatively narrow and tall. In order to store such vessels of liquid in the refrigerator so as to allow them to be dispensed cool, a user will generally have to have a large upright space available in the refrigerator. This storage space is often limited to a single shelf of the refrigerator (often the top shelf) which can make storing the jugs and using the jugs difficult. Further, to be able to pour from these vessels, they often have handles which stick outwards from them and increase the effective footprint of the vessel, therefore requiring more shelf space than is desirable.

To try and deal with this problem, many individuals now use various liquid dispensers in their refrigerator. These are devices designed to sit on a refrigerator shelf generally having a dispensing valve on the lower surface therefore, which hangs over a shelf in the refrigerator and allows for dispensing of fluid from the bottom of the device. These liquid dispensers have the advantage of allowing "squarer" storage of fluid in the refrigerator and in the net taking up less space and being able to more easily store. In particular, liquid dispensers are often shaped so as to have a larger footprint, but a significantly decreased height allowing them to sit on shelves more easily. Further, because liquid dispensers can be more rectangular and often do not need a pouring handle, they can more efficiently fill space.

Liquid dispensers, however, have the problem of being damaged by fluids within them. The liquid dispensers generally are hollow vessels which enclose the fluid and prevent it from escaping. They also will usually include an attached spigot or other dispensing device to allow the fluid to be dispensed in a controlled manner to a user. Fluid is generally added from above by removing the top panel of, or opening an access point in, the vessel and placing the fluid directly against the interior walls of the vessel and inside the hollow interior. A top or a cap may then be used to prevent introduction of outside substances into the fluid.

In this arrangement, the inside surfaces of the dispenser can become contaminated with particles of the fluid or items suspended in the fluid. An excellent example is when a powdered soft drink mix is dispensed from the vessel. Powdered soft drink mixes come in a variety of forms and under a variety of trade names but generally are designed to add concentrated flavoring and/or coloring to water to improve taste or appearance. Many also include concentrated vitamins, minerals or other enhancers to improve the nutrition from drinking the soft drink mix over drinking regular water. Many also include granulated sugar. These soft drink mixes are added to water where they dissolve or are suspended in the water.

Many vessels used to store liquids are constructed of plastics to decrease weight, decrease production cost, and make the vessels more rugged and survivable. When a soft drink mix (in solution) is placed against these materials, the vessel's surfaces can absorb or be coated by some of the powdered solution suspended in the water which adheres to the surface as opposed to remaining suspended in solution. Further, taste and odors from the soft drink mix can permeate the vessel. This "contamination" can cause problems to the vessel. For one, contamination can change the taste of other fluids dispensed from the vessel in an unpleasant fashion. For instance, a grape flavoring contaminating a vessel can be partially transferred to later added ice tea flavoring, creating an unpleasant combination. This can be particularly true with beverages having a particularly strong taste such as coffee. Sometimes, a strongly flavored beverage can so impregnate the walls that its scent or taste cannot be removed even with a thorough cleaning. This can prevent a vessel from being reused with other flavors of fluid, and can even require the vessel's destruction if it cannot be used anymore due to the flavor impregnation. Contamination can also lead to the introduction or growth of microorganisms which can make the vessel unsanitary for future use regardless of the impact on flavor. Still further, cleaning agents used to clean the vessel also can impart tastes and odors that can flavor a later dispensed liquid.

Additionally, because the fluid is placed directly within the hollow interior of the vessel, various impurities can also be introduced to the fluid. For instance, if a lid is not provided to the vessel, dust, other particulates, or microorganisms may be introduced into the fluid over time. Further, if the vessel remains empty and is then filled, dust or other particulates may have been introduced to the empty vessel which are then suspended in the fluid when it is added and may be dispensed.

Further, because the vessel must be "watertight" in order to prevent leakage of the fluid being dispensed, market distribution and storage of empty dispensers, or dispensers sold with fluid therein, will often take up significant space inefficiently, as such dispensers often cannot collapse and are not sized and shaped to pack efficiently for travel. Therefore, a user may often have wasted space taken up by the dispenser when it is not in use because the dispenser cannot be broken down or collapsed. Further, because it is generally a fairly costly device, users are reluctant to discard an unused dispenser unless they are certain they have no further need for it.

SUMMARY OF EMBODIMENTS OF THE INVENTION

In light of the above problems and for reasons known to or understood by those of ordinary skill in the art, there is discussed herein a dispensing apparatus that includes a container designed and shaped to hold fluid provided in a bag, and allows dispensing of fluid therefrom. For purposes of dispensing from an embodiment, a bag of fluid is placed into the container, the bag is penetrated by a spike, allowing fluid from the bag to flow through a portion of the spike to a dispensing mechanism. In an embodiment, the dispensing apparatus is conveniently stored on and used from a shelf of a refrigerator. More generally, an embodiment of a dispensing apparatus may be used to provide the benefits of existing chilled water dispensers in areas where piped water supply services may not be available or may not provide water of a desired quality, or simply as an alternative to existing chilled water dispenser designs.

A fluid dispensing apparatus comprising a bag containing fluid, a container that provides support for the bag, a spike comprising a hollow stem through which fluid can flow, the spike being connected to the bag at a joint created upon the puncturing of the bag by the spike, and a dispensing mechanism for controlling the flow of fluid from the bag, the dispensing mechanism connected to the hollow stem, wherein once the dispensing mechanism is operated to allow fluid flow, dispensing of fluid is the result of the force of gravity acting on the fluid. In an embodiment the spike comprises a right circular conical tip having an angle of expansion in the range of about 30 to about 60 degrees. In an embodiment the bag is constructed of a single ply of polyethylene having a thickness in the range of about 3 to about 4 mil. In an embodiment the bag comprises a fitment attached to the inside of the bag, which in a further embodiment interacts with the spike to create a fluid tight seal. In an embodiment, the bag and the spike form a seal through the interaction only of the spike, the bag, and the fluid, or alternatively, only through the interaction of the spike and the bag. In an embodiment, the spike is integral with the container and is designed not to be removed therefrom. In an embodiment, the container comprises at least one vent.

A further embodiment is a method for dispensing fluid from a bag comprising providing a bag containing fluid, supporting the bag in a container, connecting the bag to a spike by puncturing the bag with a spike comprising a hollow stem through which fluid can flow, and controlling the flow of fluid from the bag using a dispensing mechanism connected to the hollow stem, the flow being the result of the force of gravity acting on the fluid.

In an alternate embodiment, the fluid dispensing apparatus comprises a bag containing fluid, a container that provides support for the bag, a sloping support against which the bag rests within the container, a spike comprising a hollow stem through which fluid can flow, the spike being connected to the bag at a joint created upon the puncturing of the bag by the spike, and a dispensing mechanism for controlling the flow of fluid from the bag, the dispensing mechanism connected to the hollow stem, wherein once the dispensing mechanism is operated to allow fluid flow, dispensing of fluid is the result of the pressure differential generated by a force other than the force of gravity acting on the fluid. In such an embodiment the pressure differential resulting in dispensing is generated by one of a pump, a bladder, a screw, or a piston acting on the fluid in the bag.

DETAILED DESCRIPTION OF PREFERRED EMBODIMENT(S)

Figure 1:
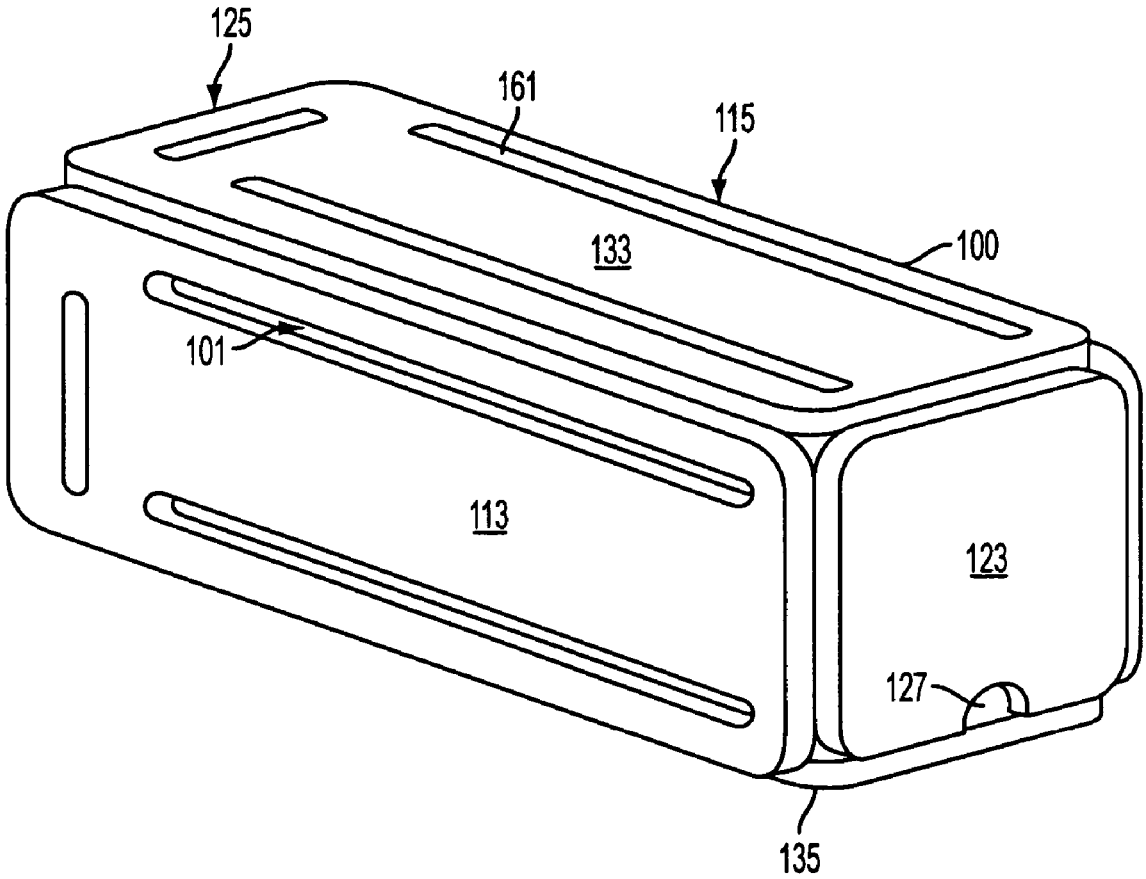
FIG. 1 provides a perspective view of an embodiment of a container which is an element of a dispensing apparatus.

FIG. 1 provides for an embodiment of a container (100) for use with bagged fluid as an element of a dispensing apparatus. The container (100) is preferably of a parallelepiped design, though any shape may be used, and includes a hollow interior for placement of a bag of fluid. The parallelepiped design is preferred for several reasons, including that a container (100) so shaped generally has a useable volume comprising more of its hollow interior than do many other shapes, the container (100) will not roll or tip easily, and portions of the container (100) do not unnecessarily overhang the surface supporting the container (100) so as to increase the container's effective footprint.

Figure 2:
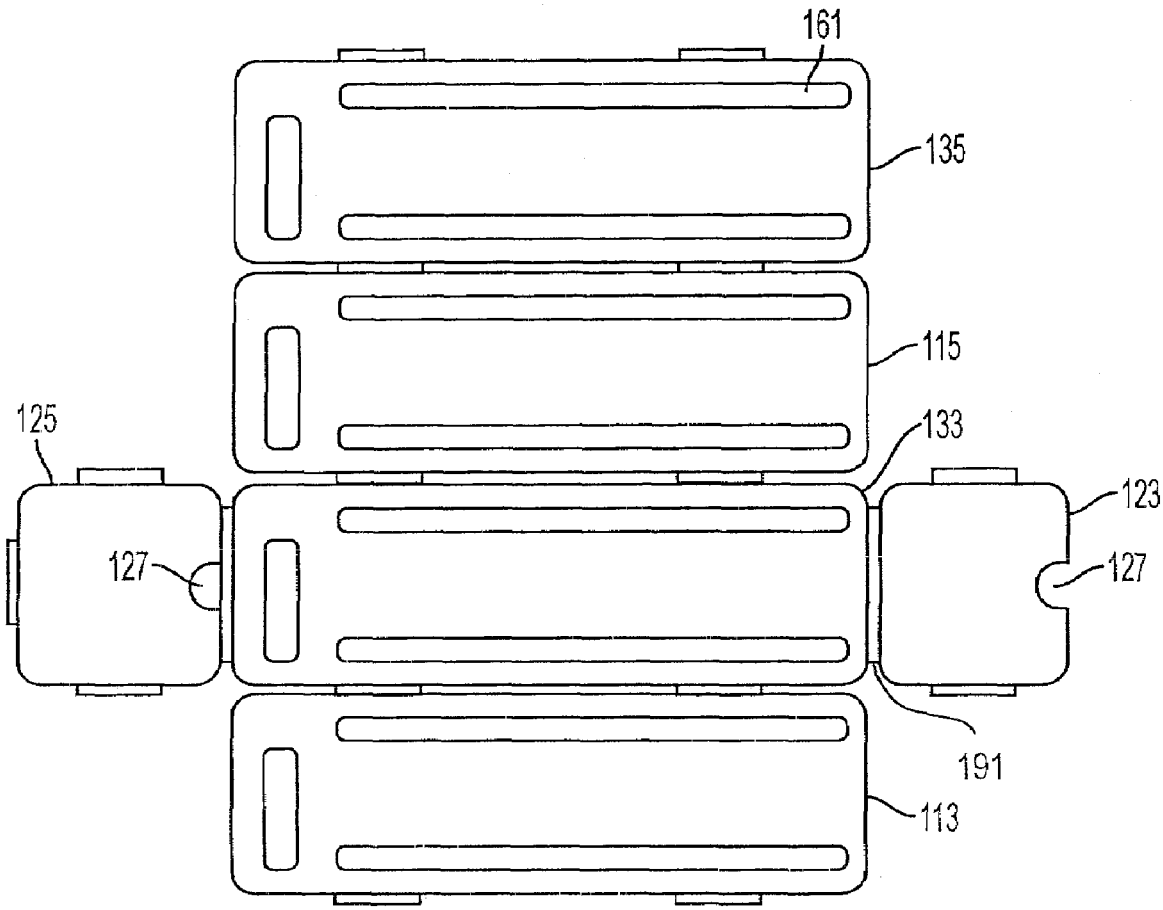
FIG. 2 provides a plan view of the container embodiment of FIG. 1 in an unassembled state.

In the depicted embodiment of FIGS. 1 and 2, the container (100) comprises six panels that generally constitute the six sides of a parallelpiped box: two sides (113) and (115), two ends (123) and (125), a top (133), and a bottom (135). At least one end (123) will generally include an aperture (127) through which a spike (201) (see FIG. 3) can pass. The container (100) provides an interior volume (101) that is surrounded by the panels of the container (100). While it is preferred that the container (100) so surround the interior volume (101), this is by no means required. In an alternative embodiment, one or more of a top (133), bottom (135), end (123) and (125), and a side (113) and (115) may be eliminated to provide a container having fewer than six panels.

The container (100) will generally be of rigid or semi-rigid construction with sufficient strength to resist deformation by the placement of a bag (300) (see FIG. 3) of fluid within the container (100). This characteristic will often result from the container (100) being made of wood, plastic, metal, glass, reinforced cardboard, or other similarly supportive materials. Other materials, including laminates and composites, are also useable for construction of an embodiment of the container (100). In another embodiment, the material itself may not necessarily provide the strength required to resist deformation, but the container (100) instead may be assembled so as to provide sufficient strength to resist excessive deformation through principles of engineering well known to those of ordinary skill in the art, including the use of a rigid frame covered with a flexible material.

As shown in FIG. 2, a cutout (200) may be formed from a flat sheet of material, such as a foamed organic polymer material. The cutout (200) may then be bent and adhered or attached to itself to form a parallelepiped container (100), such as shown in FIG. 1. This cutout (200) may be formed using any means known to the industry, and out of virtually any material. The sheet of the material may be cut into the desired cutout (200) through any method known to those of ordinary skill in the art such as, but not limited to, die stamping, rotary presses, or heat cutting. Depending on the method of assembly, the cutout (200) may be able to be formed into the container (100) of FIG. 1 only a single time; or alternatively, the container (100) after being so formed may be able to be broken down into the flat cutout (200) of FIG. 2, and such assembly and disassembly achieved multiple times. This latter embodiment (allowing multiple assembly and disassembly) can provide for easier storage of the container (100) by the user when the container (100) is not being used to hold a fluid bag (300) (see FIG. 3). In an embodiment manufactured as a cutout (200), the container (100) can be commercially distributed, as well as sold to a user, in the collapsed state (as a cutout (200)), which allows for easier shipping by a manufacturer, since if shipped broken-down (as a cutout (200)), more of the cutouts (200) can fit in a certain volume than can the assembled parallelpiped containers (100).

In an alternative embodiment, the container (100) may be manufactured originally as a parallelpiped (with six or fewer sides) or in another shape, using a process such as plastic extrusion, molding, or other methods, and may be crushable, collapsible, or rigid, depending on the desired construction.

The cutout (200) depicted in FIG. 2 will generally be folded to form the parallelepiped of FIG. 1 prior to its use. In a preferred embodiment, the folding of the cutout (200) may be performed by an end consumer and may be performed in a manner so that the resulting container (100) surrounds a bag (300) of water or other fluid. The bag (300) is preferably pre-formed and pre-filled with fluid so as to have an external shape when filled generally similar to the internal volume of the container (100), though in this context a generally cylindrical bag is generally similar in shape to the internal volume of a parallelpiped container (100) wherein the diameter of the bag is similar to the width of the parallelpiped and the lengths of the bag and the parallelpiped are similar. When the bag (300) is of similar shape to the container (100), the filled bag (300) is relatively closely constrained by the walls of the container (100) when placed therein.

Positioning of the bag (300) within the container (100) may occur by folding the bag (300) into the container (100), such as by having the user fold the cutout (200) of FIG. 2 around the bag (300), or the bag (300) may be inserted into the container (100) once the container (100) has been formed or partially formed into the parallelepiped shown in FIG. 1. In another embodiment, the container (100) may be supplied to an end consumer with a bag (300) already included within it. Such a pre-formed container (100) and bag (300) combination saves the user from having to assemble the container (100).

Figure 4:
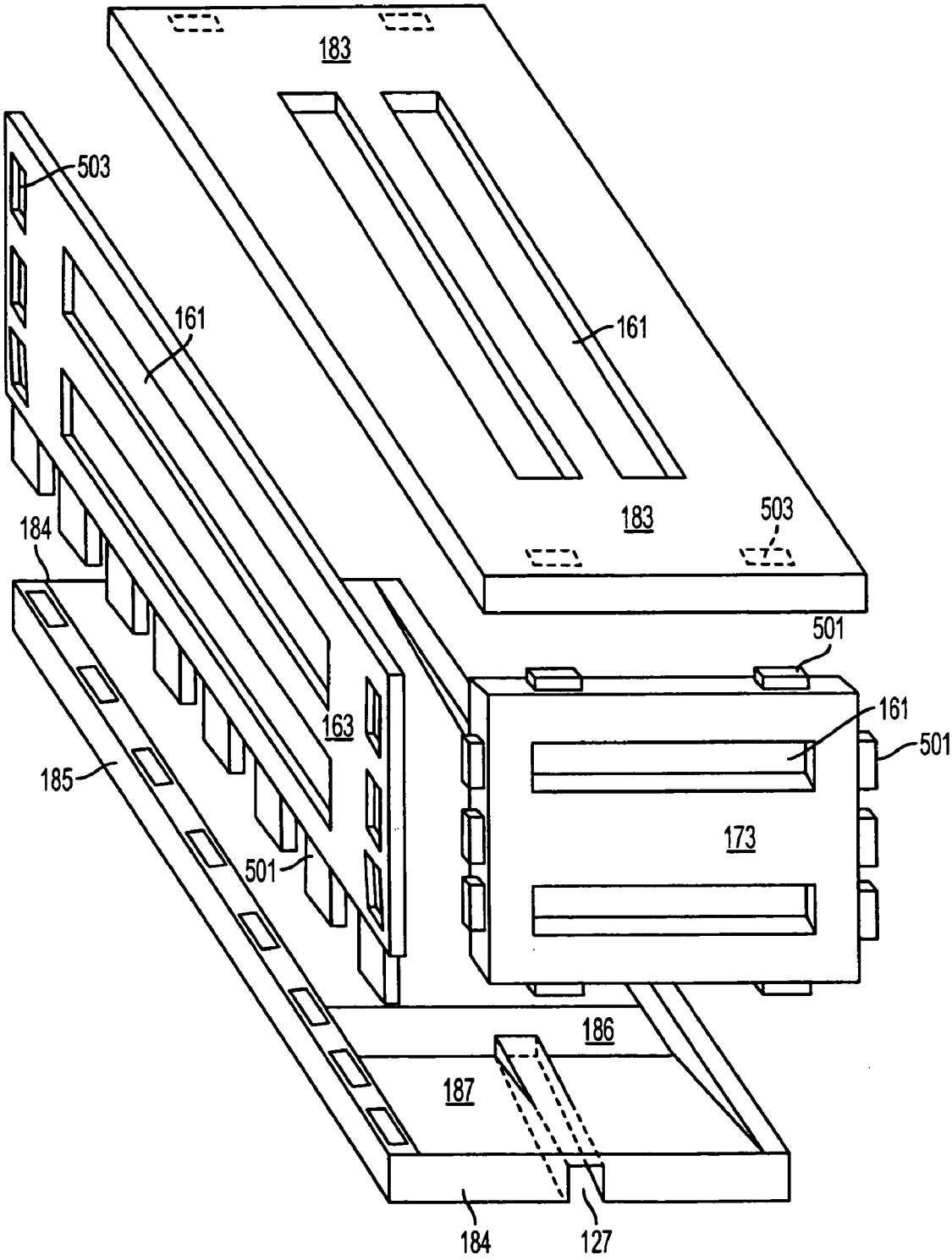
FIG. 4 provides an exploded perspective view of a portion of an embodiment of a container element of a dispensing apparatus.

FIG. 4 provides a partial illustration of a container (150) that is an alternative embodiment of the container (100). The container (150) is used in a generally similar fashion to container (100) and may be interchangeable therewith in certain circumstances. Container (150) may be manufactured using similar methods and materials as were described for container (100) or may be made using other methods and materials as known to those of ordinary skill in the art. In the embodiment of FIG. 4, the container (150) comprises multiple separate components or pieces. Each piece generally comprises a single panel and may include any number (or none) of connecting tabs (501) and connecting slots (503). The set of pieces comprising the container (150) generally includes two ends (173), two sides (163), a top (183), and a bottom (185). To assemble the container (150) as a parallelpiped, the tabs (501) of various pieces are placed in corresponding slots (503) in various other pieces. The illustration of FIG. 4 shows four of the six sides of a parallelpiped container (150) exploded to depict how the pieces fit together through interaction of the tabs (501) and slots (503).

In this embodiment, the bottom (185) of the container (150) has a specially designed sloping support (187) (i.e., the surface facing the interior volume (101)) termed the sloping support. The sloping support (187) slopes downward from both ends (184) of the base (185) towards a flat portion (186) of the sloping support (187) such that the flat portion (186) is positioned at a reduced elevation compared with the height of the sloping support (187) at either end (184). As a result of the slope of the sloping support (187) of the base (185), when a bag (300) of fluid is placed in the container (150), fluid in the bag (300) is directed by gravity toward the flat portion (186). As discussed below, in an embodiment the bag (300) is punctured by a spike (201) at a position on the bag (300) that rests essentially on the flat portion (186), thereby aiding in the emptying of the fluid from the bag (300) since such emptying will result from fluid flow through a portion of the spike (201). In alternate embodiments, the sloping support (187) may be conical or pyramidal or otherwise shaped so as to direct fluid in the bag (300) to a certain area of low elevation, which need not be flat as is the flat portion (186) of this embodiment.

As is depicted in the embodiments shown herein, the various panels of the container (100) or the container (150) may include air holes or vents (161) linking the internal volume (101) of the container to the environment external to the container. These vents (161) may decrease either one of the cost of manufacture and the weight of the container (100). These vents (161) are generally useful for improving air circulation within and around the container (100) as compared with a container (100) that does not have vents (161). Due to such improved air circulation, these vents (161) may accelerate temperature equilibration of fluid in a bag (300) positioned within the container (100) with the temperature of the environment external to the container (100). As compared with the fluid in a bag (300) that is supported within a container (100) without vents (161), such accelerated temperature equilibration may occur, for instance, when a bag (300) of fluid at room temperature is put in a container (100) in a refrigerator. Increased air circulation may also aid in allowing for the evaporation and escape of condensation or other liquid from inside the container (100). If liquids were allowed to be retained in a closed environment within the container (100), there may be a growth of bacteria, molds, or other potentially harmful organisms inside the container (100) that may result in an unappealing or even hazardous situation, such as in an event that these organisms become dispensed with the fluid.

Figure 7:
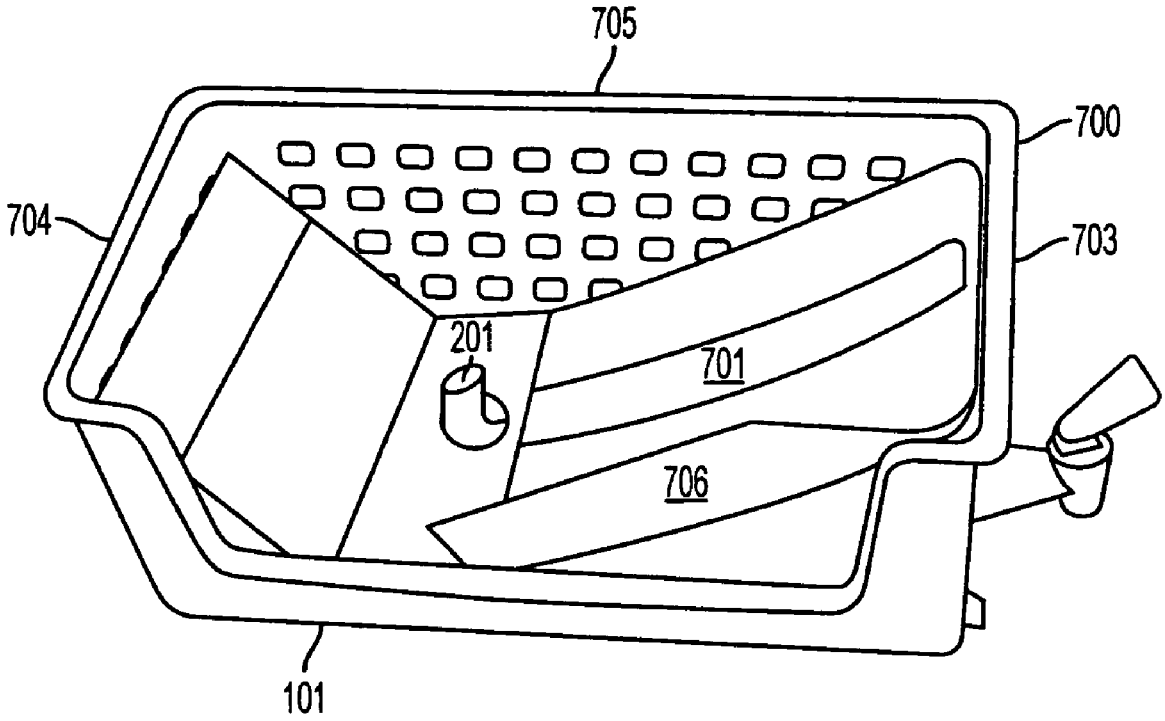
FIG. 7 provides a perspective view of an embodiment of a container of a dispensing apparatus, including a spike and spigot.

In a still alternate embodiment shown in FIG. 7, the exterior of the container (700) is a single molded plastic form having a generally rectangular bottom (706) and three generally upright sides (705), creating a form that is generally parallelpidedic in shape, but having only four primary panels rather than six as discussed with respect to the container embodiments above. Although described as generally parallelpipedic in nature, the generally upright sides (705) of the container (700) angle outward from the bottom (706), somewhat askew from being perpendicular therefrom, such if there were a top opposite the bottom (706), the dimensions of the top would be somewhat larger than those of the bottom (706). The sides (705) are manufactured with multiple vent holes (161), though the two absent sides (one upright side and one top) are vents (161) of sufficient capacity to allow the circulation described above and negate the need for vents (161) in the extant sides (705) to allow the same. The openness of the container (700) due to the absence of two sides allows easy access to the interior volume (101) of the container (700), making the placement of the bag (300) in the container (700) relatively easier than if only one or neither of the open side and top were open.

The container (700) also has an sloping support (701) for the bag (300) that is generally a smooth, curved surface, sloping from about the height of the container (700) at the two ends (703 and 704) toward a low point (707) along the sloping support (701) at a fixed distance from each end (703 and 704). The sloping support (701) in this embodiment is the surface that provides the primary force of support generally opposite to the force of gravity. In alternate embodiments, the sloping support (701) may be of varying slope or curvature or may have a constant slope along the length between its highest point and the low point (707). The highest point need not be equivalent to the height of a side (705), as in the depicted embodiment, but must only have a higher elevation than the low point (707).

Figure 3:
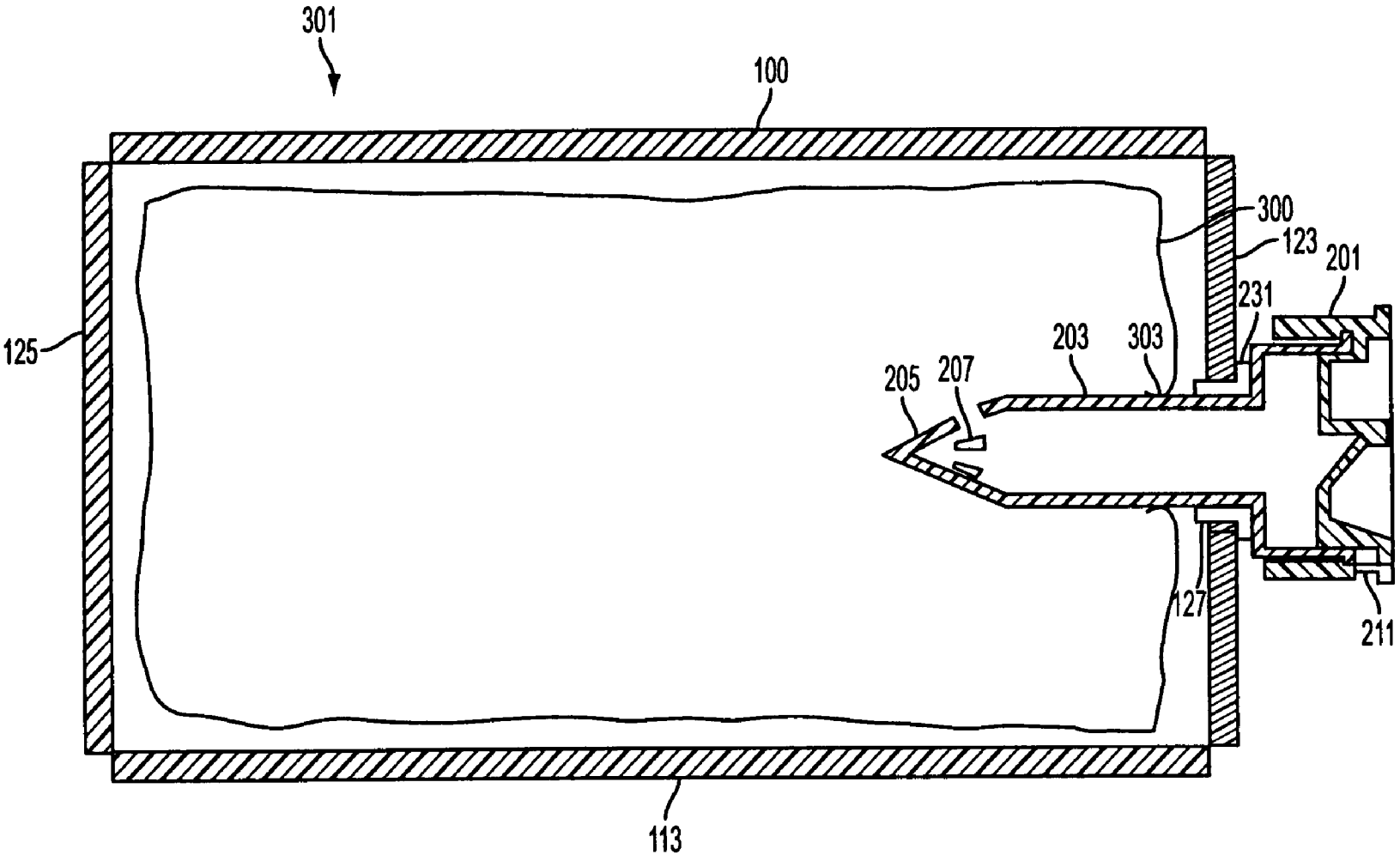
FIG. 3 provides a cross-sectional view of an embodiment of a dispensing apparatus, including the container embodiment of FIG. 1, a bag of fluid, and a spike and spigot.

The container embodiments shown in FIGS. 1, 4, and 7 are designed to be used in combination with a bag of fluid so as to provide a fluid dispensing apparatus. The following description of the use of a bag (300) of fluid with the an embodiment of the container (100, 150, or 700) will reference primarily the first embodiment of the container (100) but is generally applicable to other embodiments. In an embodiment of the dispensing apparatus a bag (300) of fluid is positioned in the internal volume (101) of a container (100) and enclosed thereby. The bag (300) positioned in a container (100) may be adhered to the container (100) for any reason such as providing added support and stability to the bag (300) but is preferably not so adhered to the container (100). A user then inserts a spike (201) through the aperture (127) in the container (100) and through the outer wall of the bag (300), both connecting the spike (201) with the container (100) and puncturing the bag (300) in essentially the same motion. The result of the puncturing of a bag (300) placed in the container (100) is depicted in FIG. 3. In alternate embodiments the puncturing of the bag (300) with a spike (201) occurs while the bag (300) is being placed in the container (100) as a direct result of such placement, or prior to the bag (300) being placed in the container (100).

FIG. 3 shows a cross-sectional view of an assembled dispensing apparatus (301) using the first embodiment of the container (100) and comprising the container (100), the fluid-fluid-filled bag (300) and the spike (201). As illustrated in FIG. 3, the spike (201) is positioned through the aperture (127) in the front end (123) of the container (100) and penetrates through a wall of the bag (300). By penetrating the bag (300), the spike (201) allows for the dispensing of the fluid held in the bag (300) as discussed below after a discussion of the bag (300) and the spike (201). In an embodiment, in order to improve the connection of the spike (201) to the container (100) and potentially to improve the appearance of the resultant combination, the spike (201) includes a collar (231) designed to interface with the aperture (127) as shown in FIG. 3. This collar (231) allows the spike (201) to be held by the end (123) of the container (100) in a predetermined position relative to the container (100) and the bag (300). In this embodiment, the collar (231) provides reinforcement and stabilization to the spike (201), especially during dispensing.

The bag (300) useful in a dispensing apparatus such as described herein may be made of any suitable material, but is preferably made of a plastic material such as an organic polymer sheet material and is preferably flexible and pliable and does not impart a rigid shape to the fluid. The bag (300) may, however, be filled with fluid to a point that the fluid is under pressure resulting from the elasticity or relative inelasticity of the bag (300), forming a relatively inflexible combination when the bag is sealed. The bag (300) also may be of any suitable construction. In an embodiment the bag (300) comprises a single-layer film wall. In an alternate embodiment a bag (300) may be constructed with several plies of material or a set of bags placed one within another. Such a multi-layer bag system may include what is commonly referred to in the art as a secondary containment or an overwrap. For a bag (300) having several layers, one or more of the layers may be removed prior to placing the bag (300) in the portable water cooler (101). In a preferred embodiment the bag (300) is constructed of a coextrusion or laminate plastic sheet material that provides a enhanced vapor and gas barrier as compared to a single-layer polypropylene film. The bag (300) may be filled with any fluid which is desired to be dispensed, including an isotonic saline solution and a beverage of various kinds, including water, milk, and citrus beverages, among others.

In the embodiment shown in FIG. 3, the spike (201) allows for dispensing of fluid from the bag (300). In the preferred embodiment, the spike (201) comprises a hollow, generally cylindrical stem (203) topped with a pointed tip (205). In the embodiment shown in FIG. 3, the tip (205) of the spike (201) comprises a circular cone positioned at an end of the stem (203) and having a radius at its base identical to, or slightly smaller than, the largest radius of the stem (203). In an embodiment the tip (205) is a right circular cone having an angle of expansion in the range of about 30 to about 60 degrees. At least one of the tip (205) and stem (203) includes at least one, and generally a plurality, of holes (207) placed therethrough leading from external to the spike (201) into the hollow interior of the stem (203). The hollow interior of the stem (203), is connected to a spigot (211) or other dispensing valve, either directly or via the interior of a pipe or other travelway. In the configuration of FIG. 3, fluid in the bag (300) can travel through the holes (207) into the hollow interior of the stem (203) and, thus, is provided with access to the spigot (211), which enables dispensing through the spigot (211). In the depicted embodiment, the stem (203) encompasses the cross-sectional width of the spike (201) such that the outer dimension of the stem (203) is identical to the outer dimension of the spike (201) along the length of the stem (203). In an alternate embodiment, the stem (203) is only a portion of the cross-sectional width of the spike (201).

The process of penetrating the bag (300) with the spike (201) may take many forms depending on the embodiment of the dispensing apparatus. In an embodiment such as just described, the spike (201) is simply hand-driven into the bag (300). When spiking a bag (300) the bag (300) simply may be held in one's hands or placed on a convenient work surface, or more preferably is placed within the container (100). As discussed above, the container (100) is preferably sized and shaped so that the filled bag (300) has similar external volume to the internal volume of the container (100). Therefore, if the bag (300) is placed in an assembled or partially assembled container (100), the bag (300) should be sufficiently constrained to allow penetration by the spike (201) when the spike (201) is forced against the wall of the bag (300), rather than such a force simply moving the wall of the bag (300) without penetrating the wall of the bag (300). In an alternate embodiment, the inertia of the fluid-filled bag (300) is sufficient to allow spiking without further containment of the bag (300).

In an alternative embodiment, such as one using the third embodiment of the container (700), wherein the spike (201) projects upwardly (as shown in FIG. 7), the weight of the of the fluid in the bag (300) is used to push the outer wall of the bag (300) onto the spike (201) that is already attached to the container (700). In such an embodiment, the combined weight of the bag (300) and the fluid in the bag (300) supplies sufficient force that the spike (201) penetrates the outer wall of the bag (300), connecting the spike (201) directly to the fluid inside the bag (300).

In an alternate embodiment using the first embodiment of the container (100) the end (123) is attached to another panel of the container (100) at a hinge that includes a spring or similar biasing device (191) that tends to rotate the end (123) from a flat position as in FIG. 2 into an uprights position as in FIG. 1. With this embodiment, the user can place the bag (300) in the container (100), mount the spike (201) in the aperture (127) in the end (123) while the end (123) is being held in a flat or otherwise open position, and then release the end (123) to rotate under the force of the biasing mechanism into the upright position of FIG. 1, causing the mounted spike (201) to penetrate the enclosed bag (300).

Figure 10:
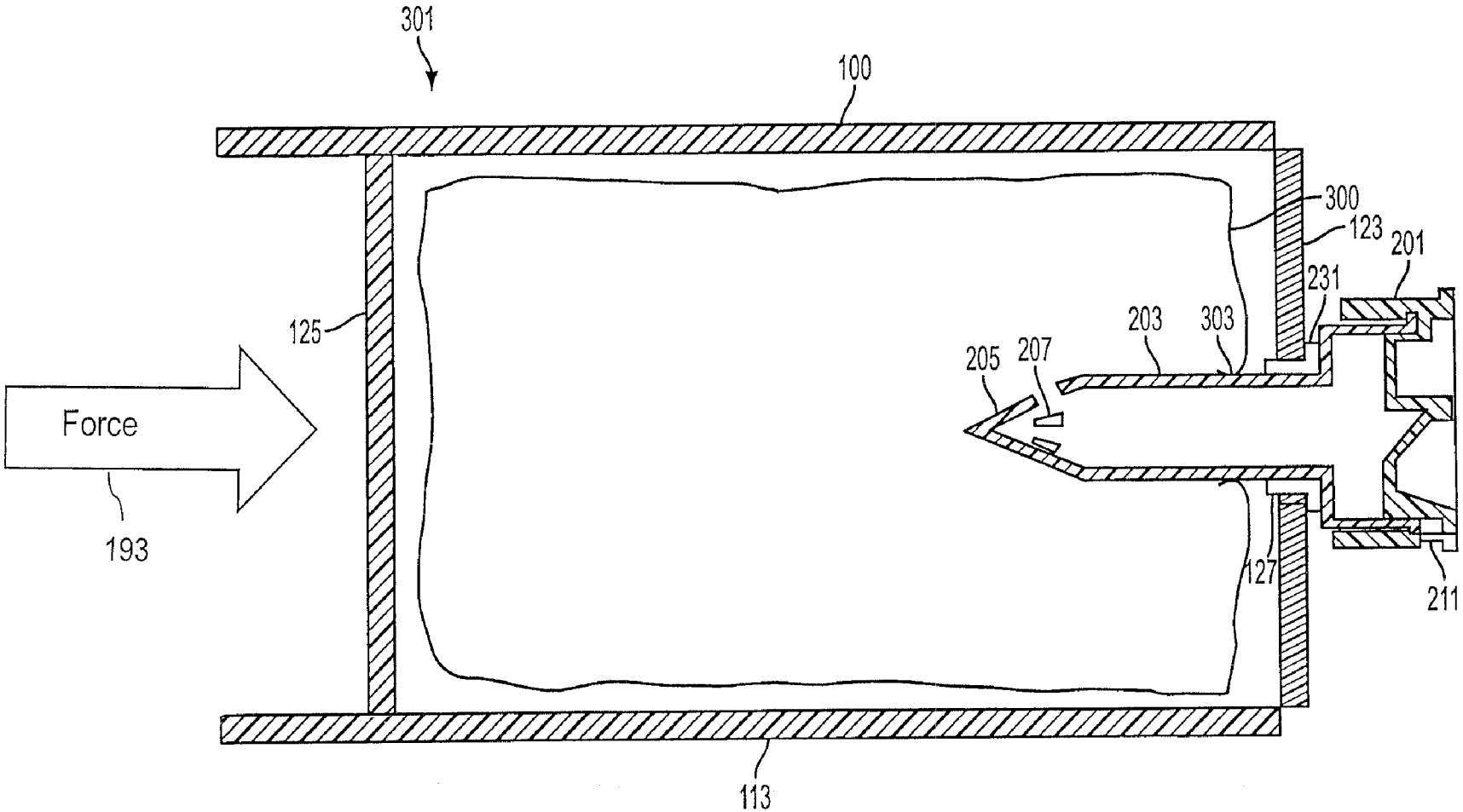
FIG. 10 provides a cross-sectional view of an embodiment of a dispensing apparatus, depicting a force applied to the bag.

In still another embodiment, the spike (201) and bag (300) combination may work with an extension screw, piston, bladder or other similar drive mechanism that can create a force that pushes the bag (300) against the spike, whether the mechanism works on the bag (300) or the spike (201) or both. In one such embodiment using the first embodiment of the container (100), the bag (300) is placed in the container (100) and the spike (201) is positioned in the aperture (127) in the end (123) which end (123) is then brought into the parallelepiped arrangement of FIG. 1 without the bag (300) being penetrated by the spike (201). As depicted in FIG. 10, a force (193) is then generated against the end (125) of the container (100) in the direction of the spike (201) using a crank, a screw, a spring, a bladder, or a person's hands. In this embodiment, the end (125) is free to move relative to the rest of the container (100), such that the force on the end (125) is applied to the bag (300) positioned in the internal volume (101), forcing the bag (300) against the spike (201), which is held stationary in the end (123) relative to the rest of the container (100). This results in the bag (300) and spike (201) being pushed together, and ultimately the penetration of the bag (300). Many arrangements of such a drive mechanism can be engineered to force the bag and the spike together, as would be understood by one of ordinary skill in the art.

In a preferred embodiment, the interaction of the bag (300) and the spike (201) is such that after the bag (300) is pierced, the opening in the bag (300) seals around the spike (201), thus preventing leakage of any significant amount of fluid from inside the bag (300) into the internal volume (101). Such sealing may be the result of a sealing interaction between the bag (300) and the spike (201) alone, the bag (300), the spike (201), and the fluid in the bag (300), or may be a result of an interaction between the spike (201) and at least one other element, such as the fitment (801) described below.

Where a sealing interaction is between the bag and the spike alone, sealing of the bag (300) about the spike (201) is accomplished when the stem (203) is sized and shaped so that as the wall of the bag (300) is deformed and broken by the tip (205), the integrity of the wall of the bag (300) remains intact around the entire circumference of the spike (201). In an embodiment, the integrity of the bag (300) will remain intact up to the point of contact between the bag (300) and the spike (201), as well as for some length along the spike (201) in a direction generally perpendicular to a diameter thereof (e.g., along a cuff (303) as discussed below). In an alternate embodiment the cuff (303) may not be uniform around the circumference of the spike (201), and may be minimal to non-existent along a portion of such circumference. In an embodiment, the physical properties of the bag material (e.g., elasticity) promote the sealing of the bag (300) about the spike (201).

Figure 5:
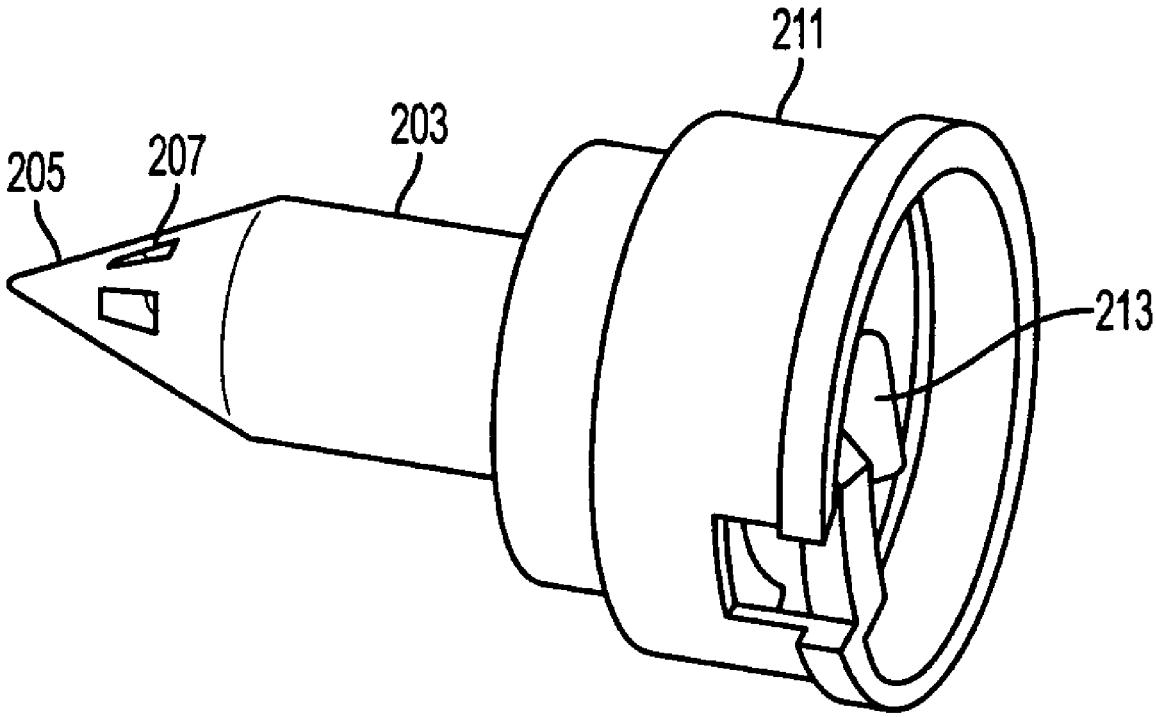
FIG. 5 provides a perspective view of an embodiment of a spike and spigot that may be used with a dispensing apparatus.
Figure 6:
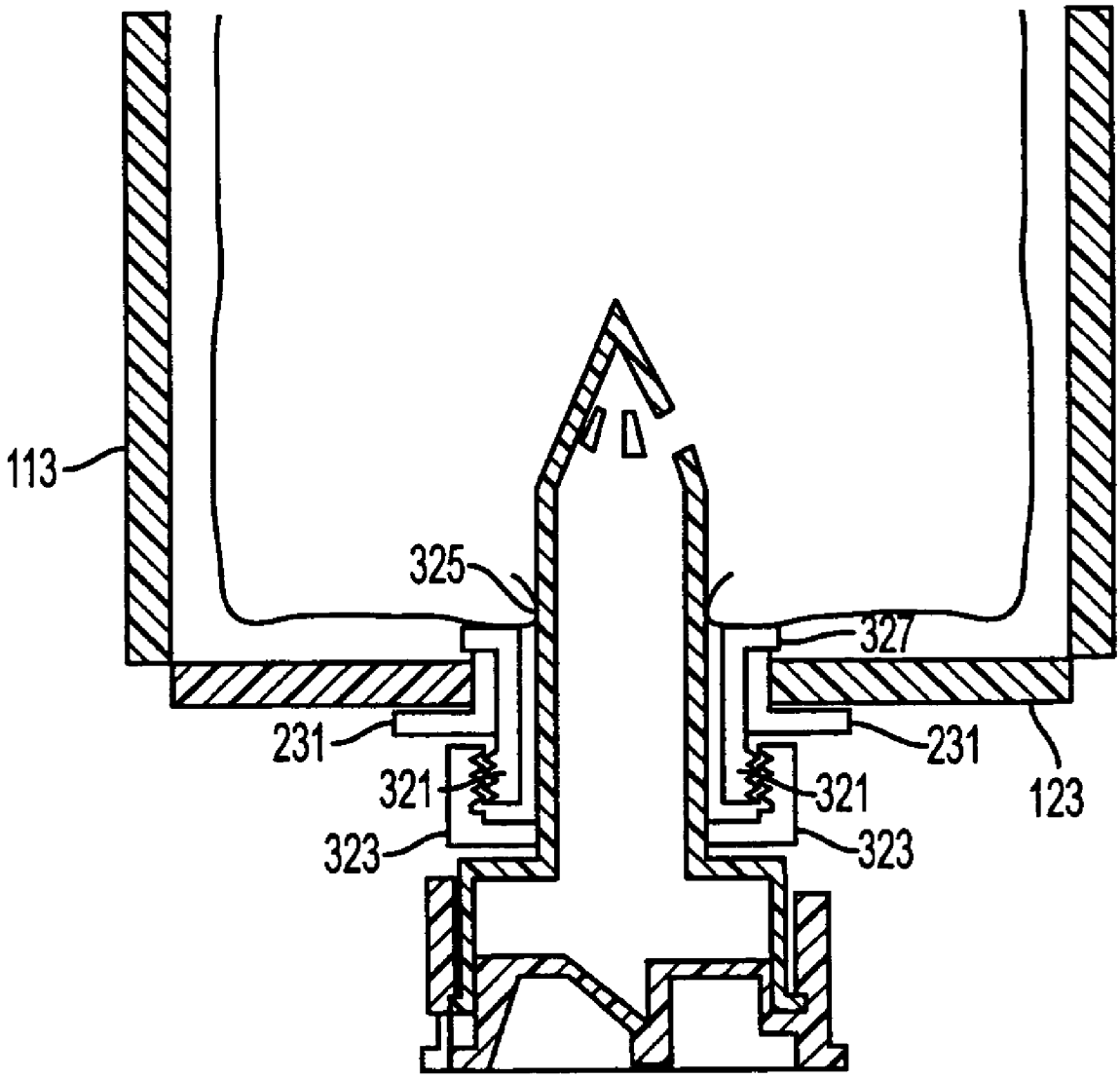
FIG. 6 provides a cross-sectional view of an embodiment of a dispensing apparatus showing an embodiment of a mating connector for joining a bag and a spike.

In an embodiment such as shown in FIGS. 3, 5, and 6, the spike (201) includes a cylindrical stem (203) and a tip (205) that comprises a circular cone positioned at an end of the stem (203) and having a radius at its base identical to, or slightly smaller than, the largest radius of the stem (203). In this configuration, as the bag material is punctured by the point of the cone, the opening in the bag (300) is gradually enlarged as the bag (300) is pushed over the cone of the tip (205) and onto the stem (203). During this puncturing process, the wall of the bag (300) may tend, in effect, to roll inward and upward along the tip (205) and the stem (203), thus creating a cuff (303) of bag material that rests along a length of the spike (201) all the way around the circumference of the spike (201). Having been forced onto the stem (203), the opening in the bag (300) is sealed against the stem (203), the opening in the bag essentially exactly matching the shape and circumference of the stem (203). To some extent, the seal is aided by pressure exerted by the fluid, tending to push the cuff (303) of the bag against the spike (201).

The exact size and shape of the tip (205) and stem (203) useful for forming a seal for preventing or sufficiently hindering leaks depends on many factors, including the dimensions of the bag (300), the materials used in the bag's construction, and the type and amount of fluid contained therein, among others. Specific values for any of these factors in any embodiment are a matter of engineering design choice.

Generally, for a conical tip (205) as described above, the cuff (303) of a single sheet polyethylene bag will have a length (height) that is fairly constant around the circumference of the spike (201), and that is about equal to the radius (half the diameter) of a cylindrical spike (201), since the tip is symmetrical. For a spike (201) as depicted in FIG. 3 with a conical tip (205) and cylindrical stem (203) and a 3 to 4 mil single sheet polyethylene bag, a cuff (303) of less than about one-quarter inch does not seal as well as do larger cuffs (303), except when the spike interacts with another element, such as fitment (801). In this regard, for sealing without an element such as the fitment (801), bags (301) made of laminate constructions generally do not seal as well as non-laminate constructions because of the likelihood of unsymmetrical cuffs, and in particular, the possibility of crack propagation along a length generally perpendicular to the spike (201), which may compromise the integrity of the wall of the bag (300) a distance away from the spike (201) and allow leakage. Laminate bags, however, can be made to seal to a spike (201) without the use of an element such as the fitment (801).

A dispensing mechanism, such as a spigot (211) or another dispensing valve, such as one comprised by a pump, generally controls the dispensing of the fluid from the bag (300). The dispensing mechanism generally will be disposed exterior to the container (100 or 150 or 700), preferably near to the exterior wall thereof. The dispensing mechanism may have any valve design convenient for dispensing fluid on demand. In an embodiment, the spigot (211) is a simple button- or lever-operated valve that defaults to a closed position (through use of a spring or other biasing mechanism), and is opened only when the button or lever is moved against the biasing mechanism. An embodiment of such a lever-operated valve is commonly used on coffee and water dispensers for home and commercial use, including in the common office water cooler. Dispensing mechanisms encompassing valves of various designs useful for dispensing from the dispensing apparatus are well known to those of ordinary skill in the art.

Shown in perspective view in FIG. 5 and in a cross-sectional view in FIG. 3 is an embodiment of a spigot (211) that is an embodiment of a dispensing mechanism for a dispensing apparatus as herein described. Shown in FIGS. 3 and 5, the spigot (211) is attached to a spike (201). In this embodiment, the spigot (211) is a valve made of a deformable material such as rubber, and may be formed of any suitable material, including silicone. The spigot (211) is connected to the spike (201) by a snap-like connection, the two elements fitting snugly together as shown in FIG. 5, their surfaces resting against one another (see the FIG. 3 cross-section) to close the path through which fluid is dispensed. The spigot (211) may be deformed by applying a force on the lever portion (213), thereby separating a portion of the spigot (211) from contact with the spike (201), and thus allowing dispensing of fluid through the hollow stem (203) of the spike (201) and out the opening between the spigot (211) and the spike (201) created by the deformation of the spigot (211).

After placing the bag (300) in the container (100), puncturing the bag (300) with the spike (201), and creating a seal, when the dispensing mechanism is operated, fluid from inside the bag (300) can flow through the holes (207) into the stem (203), and through the stem (203) to the dispensing mechanism as the fluid is dispensed from the container (100). In an embodiment, dispensing is the result of the force of gravity acting on the fluid in the bag (300), pulling it out of the spigot (211) or other dispensing mechanism. In an alternate embodiment, dispensing is a result of a force created by other mechanisms than gravity such as the pressure differentials created by a pump connected to the spike (201) or a pressure differential created by increased pressure on the bag (300) such as may be due to the operation of a bladder, piston, screw, or other mechanism acting on the bag (300) or spike (201) as was discussed above with respect to an alternate manner of puncturing the bag (300) in place of puncturing directly by hand. An embodiment including a pump, for instance, is constructed identically to the dispensing apparatus shown in FIG. 3, except that a pump has replaced the spigot (211).

The dispensing apparatus, once assembled, will generally be placed on a shelf of convenient height, for example a refrigerator shelf, in such a manner that the dispensing mechanism extends over an edge of the shelf. The liquid can then be dispensed by the dispensing mechanism, generally in a stream that can be captured or used by a user. Once the fluid in the bag (300) has been completely dispensed, the bag (300) is removed and discarded or recycled. After fluid has been completely dispensed, though, some fluid may remain in the bag (300), for example, at the bottom of the bag (300), below the level of the holes (207) or caught in a fold in the collapsed bag (300). This residual fluid is presumed either to be purposefully fed into the holes (207) by a user, or is simply discarded with the bag (300).

When dispensing is complete (as discussed above) the dispensing apparatus (301) may be partially disassembled (depending on the embodiment) to allow for removal and discarding of the bag (300). In the process of removing and discarding the bag (300), any number of other components of the fluid dispensing apparatus (301) may be discarded as well. In an embodiment, for example, the end (123) of the container (100) is opened, generally pulling the spike (201) and the bag (300) connected thereto at least partially out of the interior volume (101). The bag (300) and spike (201) are then separated and the bag (300) is discarded. A new bag (300) is then be placed in the container (100) and the process of puncturing a bag (300) is repeated. In an alternative embodiment, the spike (201) may be disconnected from the container (100) and the bag (300) by pulling the spike (201) out of the interior volume (101), using the end (123) or other portion of the container (100) to effectively hold the bag (300), allowing the spike (201) to slide freely therefrom. In such an embodiment the bag (300) and container (100) combination may then be discarded, while the spike (201) is maintained for another use. In still a further embodiment, the entire dispensing apparatus (301), including the container (100), the bag (300), and the spike (201), may be discarded when dispensing is complete.

For embodiments wherein the sealing of the bag (300) about the spike (201) does not involve an interaction with an element besides the bag (300), the spike (201), and the fluid, the bag (300) may generally be punctured at whatever location is convenient. In the embodiment depicted in FIG. 6, however, the presence of a connector that aids in the joining of the spike (201) and the bag (300), provides a predefined location for the puncturing of the bag (300).

In the embodiment shown in FIG. 6 the spike (201) includes a mating connector (221) designed to connect to a corresponding mating connector (321) on the bag (300). The generally circular flange (327) on the bag connector (321) is welded or otherwise connected to the outside of the bag (300), enclosing a window (325) of bag material within the circumference of the flange (327). As a result of a design in which the spike (201) is meant to connect to the bag (300) at the bag connector (321), this window (325) is essentially predesignated to be the portion of the bag (300) that is punctured by the spike (201). In an embodiment, the window (325) is manufactured purposefully to improve spiking characteristics, such as initial puncture force and seal integrity.

In the embodiment shown in FIG. 6, the mating connectors (221 and 321) are generally threaded cylinders sized and shaped to be screwed together. One of the connectors (221 and 321) is a male connector with external threads and the other of the connectors (221 and 321) is a female connector with internal threads. In alternate embodiments, either of the connectors (221 and 321) can be made with either of the internal or external thread portions. A further alternate embodiment of such a connection is a tapered pressure fitting, more specifically exemplified by a first pipe having a first end with an outer diameter that is tapered along a length to a smaller outer diameter at the first end of the first pipe such that this first pipe can be pushed into and securely fit with a second pipe having an internal diameter intermediate between the smallest and largest outer diameters along the tapered length of the first pipe. Various such connectors (or fittings) using correlating fitting elements and utilizing various mechanisms of connection are known for use in numerous settings where fluid-tight connections may be desired, and such fittings can be adapted to be used to connect a sealed fluid container such as a bag (300) with a spike (201), such as by manufacturing the bag (300) with a port or an attached hose that includes an element of such a fitting.

In an embodiment as shown in FIG. 6, prior to penetration of the bag (300) with the spike (201) the bag (300) is placed in the container (100). During the placement of the bag (300) in the container (100) the bag connector (321) is positioned so as to pass through the aperture (127) and protrude from the container (100). In this embodiment the bag connector (321), rather than the spike (201) is held in a predefined position relative to the container (100) by a collar (323) that interfaces with the aperture (127). The spike connector (221) is then connected with the bag connector (321) by screwing the connectors (221 and 321) together. The connection between the connectors (221 and 321) is preferably water-tight so that if any leakage occurs about the spike (201) after puncturing the bag (300), such leakage is contained within the connectors (221 and 321). In an embodiment, the spike (201) first contacts the window (325) and then penetrates the window (325) prior to the connection between the connectors (221 and 321) being threaded to reasonable tightness. In an embodiment, such reasonable tightness makes the connection water-tight. In an alternate embodiment, penetration of the bag (300) by the spike (201) occurs after the connection between the connectors (221 and 321) has reached reasonable tightness. In such an embodiment, the spike (201) must move relative to the bag (300) to puncture the bag (300) after the connection is reasonably tight. Such movement of the spike (201) may result from the action of a biasing mechanism, e.g., an integral spring mechanism, or through an external force such as presented by a user's hand. Such a design, while it may be more complex, may provide greater protection from spillage since the penetration of the bag (300) does not occur until after the connection between the connectors (221 and 321) is complete.

Figure 8:
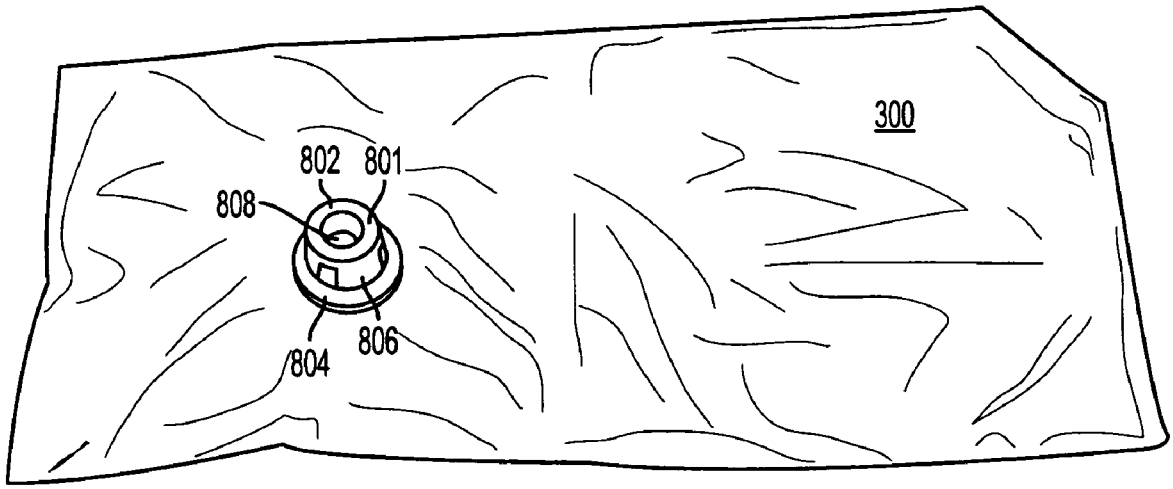
FIG. 8 provides a perspective view of an embodiment of a bag with a fitment for use in a dispensing apparatus.
Figure 9:
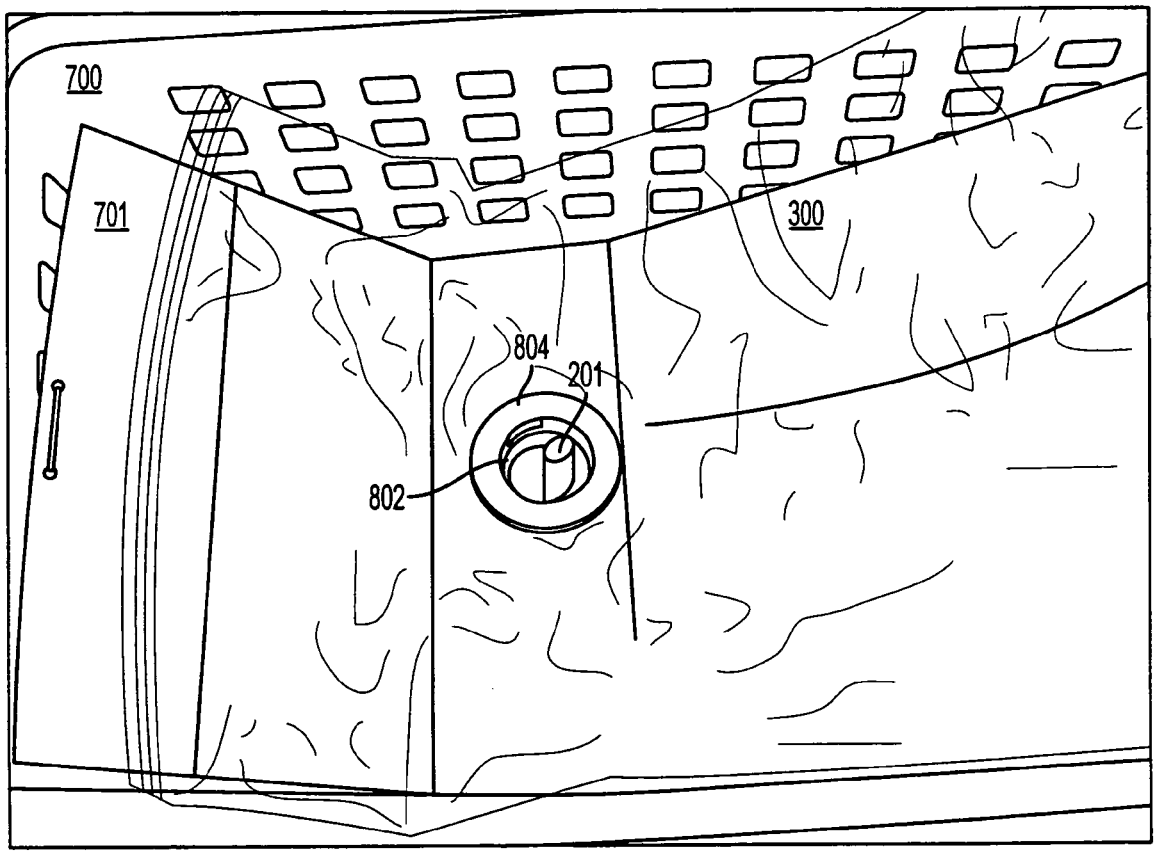
FIG. 9 provides a perspective view of the container and spike embodiments of FIG. 7 and the bag embodiment of FIG. 8 joined in an embodiment of a dispensing apparatus.

In an alternative embodiment of the dispensing apparatus, depicted in FIG. 9, the sealing of the bag (300) about the spike (201) is the result of interaction between the spike (201) and a fitment (801). This embodiment uses a bag (300) having a fitment incorporated on the interior wall, such as shown in FIG. 8. The depicted bag (300) is manufactured with a fitment (801) attached to the inside surface of the bag (300). The fitment (801) is formed of an outer ring (802) an inner ring (804) and posts (806) separating the two rings (802 and 804). The outer ring (802) is attached to the wall of the bag (300) on the inside of the bag (300) and defines a window (808) on the bag (300) within the circumference of the outer ring (802) that is intended to be punctured by a spike (201). The inner ring (804) is not attached directly to the bag (300) but is held within the bag (300) at a distance from the outer ring (802) by the posts (806). The fitment (801), then, has an internal volume between the inner and outer rings (802 and 804) that is generally maintained as the bag is emptied.

In an embodiment using the fitment (801), a spike (201) punctures the bag (300) at the window (808), passing into the bag (300) through the outer ring (802) of the fitment (801). The spike (201) and outer ring (802) are designed to fit closely together, the outer circumference of the spike (201) being of similar dimension to the inner circumference of the outer ring (802). Sealing of the bag (300) about the spike (201) results from this close fit of the spike (201) with the outer ring (802), which, in an embodiment, is enhanced by the portion of the bag (300) (similar to the cuff (303) described above) that is forced between the spike (201) and the outer ring (802) as the spike (201) punctures the bag (300). The outer ring (802) serves as a flange aiding in the security of the connection between the spike (201) and the bag (300).

As the fluid in the bag (300) is emptied through the spike (201), the bag (300) begins to collapse. In an embodiment using the fitment (801) depicted in FIGS. 8 and 9, the internal volume of the fitment (801) keeps the bag (300) from completely collapsing in the vicinity of the spike (201), thus enhancing evacuation of the bag (300) by maintaining an open channel to the spike (201). In such an embodiment, the spike (201) may be designed as shown in FIG. 6, or may have alternate designs, including, simply, a bevel cut tube. In an alternate embodiment, the window (808) is manufactured purposefully to improve characteristics leading to the connection between the spike (201) and the bag (300), such as to optimize the initial puncture force required for the spike (201) to break the window (808).

A specific example of such a bag and spike connection using a fitment is provided by Server Products, Inc., headquartered in Richfield, Wis., USA, whose Server Express™ system includes a spike that mates with a fitment in a bag, the fitment and bag combination being produced by Sealed Air Corporation of Saddle Brook, N.J., USA, under the Cryovac® name.

In yet another embodiment of the dispensing apparatus, the container may be configured or adapted to be used in conjunction with a dispensing mechanism designed and mounted as a component of a refrigerator, such as are commonly attached to a municipal water supply. The embodiments described above are generally designed to be used within a refrigerator whereby the refrigerator door is opened to obtain access to the spigot (211). In this alternative embodiment, the spike (201) may be connected to a feed mechanism, pump, pipe, or other device to allow fluid from the bag (300) to be transported to a dispensing mechanism mounted external to the refrigerator, whether pre-existing or newly mounted. In a still further embodiment, the container may be included as a permanent mount in a refrigerator or freezer, such as an in-door mount. In still another embodiment, the fluid from the bag (300) travels to an ice maker to allow the manufacture of ice from the fluid in the bag. The ice so made is then dispensed using the dispenser of the ice maker.

As should be apparent from the above description, the fluid in the bag (300) is only in surface contact with the interior surface of the bag (300), the exterior and interior of the spike (201), and the interior surfaces of the dispensing mechanism, such as the spigot (211). The fluid is not in direct contact with the inner surfaces of the container (100, 150, or 700). In this way, flavors from the fluid cannot be directly transferred to the container (100, 150, or 700). Further, even if there was contamination in the container (100, 150, or 700) (such as from a bag (300) having a leaky seal with the spike (201)), fluid in a later used bag (300) should not pick up any of the contamination, since a later used bag (300) should have a non-leaky seal that does not allow contamination into the later used fluid. Because a bag (300) of fluid can be manufactured in a manner that produces a sterile fluid in the bag (300), and because an embodiment of the dispensing apparatus limits the contact of the fluid with the external environment, such a dispensing apparatus is an aid to providing high quality, low-health-risk fluids.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A fluid dispensing apparatus comprising:

a bag containing fluid;

a container that provides support for said bag;

a spike comprising a hollow stem through which fluid can flow, said spike moveably positioned relative to said container;

a sealed joint between said spike and said bag, said joint sealed through interaction only of said spike with said bag or through interaction only of said spike with said bag and said fluid; and a dispensing mechanism for controlling the flow of fluid from said bag, said dispensing mechanism connected to said hollow stem;

wherein said spike is moved relative to said container in order to puncture said bag.

2. The apparatus of claim 1 wherein said dispensing mechanism comprises a spigot.

3. The apparatus of claim 1 wherein said stem is generally cylindrical.

4. The apparatus of claim 1 wherein said spike further comprises a conical tip that includes the conical point, said tip being a right circular cone having an angle of expansion in the range of about 30 to about 60 degrees.

5. The apparatus of claim 1 wherein said bag is constructed of a single ply of polyethylene having a thickness in the range of about 3 to about 4 mil.

6. The apparatus of claim 1 wherein said container comprises at least one vent.

7. The apparatus of claim 1 wherein said container comprises a sloping support for supporting said bag.

8. The apparatus of claim 1 further comprising a cuff about said spike, wherein said cuff comprises a portion of said bag involved in said sealed joint.

9. An apparatus for dispensing fluid comprising:

a bag containing fluid;

a means for supporting said bag that is in contact with said bag;

a means for puncturing a wall of said bag to create an opening in said bag through which fluid can flow, said means for puncturing moveably positioned relative to said container;

a seal between said bag and said means for puncturing, said seal being the result of the interaction only of said means for puncturing with said bag or the interaction only of said means for puncturing with said bag and said fluid; and a means for controlling the dispensing of fluid from said bag, said means for controlling the dispensing being connected to said means for puncturing such that fluid dispensed by said dispensing means has flowed through said means for puncturing;

wherein once said means for controlling the dispensing is operated to allow fluid flow, dispensing of fluid is the result either of the force of gravity acting on the fluid or of an external pressure exerted upon the bag.

10. The apparatus for dispensing fluid of claim 9 further comprising a means for directing said fluid toward said means for puncturing.

11. The fluid dispensing apparatus of claim 9 wherein dispensing of fluid is the result of an external pressure exerted upon the bag, said external pressure being generated by one of a pump, a bladder, a screw, a piston, a crank, a spring, or a person's hand.

12. The fluid dispensing apparatus of claim 9 further comprising a means for forcing said means for puncturing against said bag so as to puncture said bag with said means for puncturing.

13. The apparatus of claim 12 wherein said means for forcing is one of a spring, a bladder, a piston, or a screw.

14. The apparatus for dispensing fluid of claim 9 wherein said means for supporting is a container comprising multiple generally planar portions that can be repeatably assembled and disassembled to form and reform said container for reuse.

15. The apparatus of claim 14 wherein said container is of a generally parallelpiped shape defined by at least three essentially planar sides, each oriented generally orthogonally to at least one other of said sides, and wherein said sides comprise said portions.

16. The apparatus of claim 15 wherein the number of said generally planar portions is six, and wherein said six portions can be assembled into a generally parallelpiped-shaped container that essentially encloses said bag.

17. The apparatus of claim 16 wherein said six portions are connected together through the insertion of tabs of a first side into slots of a second side.

18. The apparatus of claim 14 wherein said portions are portions of a single generally planar piece of material that has been cut into a shape that can be folded to form said container.

19. The apparatus of claim 14 further comprising a sloping support within said container upon which can rest said bag.

20. The apparatus of claim 14 wherein said portions are hingedly connected to one another.

21. The apparatus of claim 14 wherein said container comprises vents allowing air circulation through said container.

22. The apparatus of claim 14 further comprising a preexisting aperture in said container through which said spike can be positioned.

23. A method for dispensing fluid from a bag comprising:

providing a bag containing fluid;

supporting said bag in a container;

moving a spike comprising a hollow stem through which fluid can flow relative to said container in order to effect a puncturing of said bag, thereby forming a seal between said spike and said bag, said seal being the result of the interaction only of said spike with said bag or the interaction only of said spike with said bag and said fluid; and controlling the flow of fluid from said bag using a dispensing mechanism connected to said hollow stem.

* * * * *